US009858871B2

(12) United States Patent
Tsunashima et al.

(10) Patent No.: US 9,858,871 B2
(45) Date of Patent: Jan. 2, 2018

(54) DISPLAY DEVICE AND REFLECTIVE LIQUID CRYSTAL DISPLAY DEVICE

(71) Applicant: Japan Display Inc., Minato-ku (JP)

(72) Inventors: Takanori Tsunashima, Tokyo (JP); Hirotaka Hayashi, Tokyo (JP)

(73) Assignee: Japan Display Inc., Minato-ku (JP)

( * ) Notice: Subject to any disclaimer, the term of this patent is extended or adjusted under 35 U.S.C. 154(b) by 199 days.

(21) Appl. No.: 14/635,389

(22) Filed: Mar. 2, 2015

(65) Prior Publication Data

US 2015/0248866 A1 Sep. 3, 2015

(30) Foreign Application Priority Data

Mar. 3, 2014 (JP) ..... 2014-040219

(51) Int. Cl.
*G09G 5/02* (2006.01)
*G09G 3/36* (2006.01)

(52) U.S. Cl.
CPC ..... *G09G 3/3607* (2013.01); *G09G 3/3611* (2013.01); *G09G 2300/023* (2013.01);
(Continued)

(58) Field of Classification Search
CPC ..... G09G 3/3607; G09G 3/3611; G09G 2310/08; G09G 2300/023;
(Continued)

(56) References Cited

U.S. PATENT DOCUMENTS

2009/0303420 A1* 12/2009 Kim ..... G02F 1/1323 349/96
2010/0013803 A1 1/2010 Noguchi et al.
(Continued)

FOREIGN PATENT DOCUMENTS

JP 2006-98613 A 4/2006
JP 2010-026245 A 2/2010
(Continued)

OTHER PUBLICATIONS

Office Action dated Jun. 20, 2017 in Japanese Patent Application No. 2014-040219 (with English language translation).

*Primary Examiner* — Nicholas Lee
*Assistant Examiner* — Gerald Oliver
(74) *Attorney, Agent, or Firm* — Oblon, McClelland, Maier & Neustadt, L.L.P.

(57) ABSTRACT

According to one embodiment, a display device includes a unit pixel including a first pixel, a second pixel neighboring to the first pixel in a column direction, a third pixel neighboring to the first pixel in a row direction, and a fourth pixel neighboring to the second pixel in the row direction, a scanning line extending in the row direction and electrically connected to the first to fourth pixels, and first to fourth signal lines extending in the column direction and provided at intervals therebetween in the row direction, and the first to fourth signal lines are electrically connected to the first to fourth pixels, and video signal potentials for inverted drive applied to the first and second signal lines are inverted in polarity with respect to each other, and those to the third and fourth signal lines are inverted in polarity with respect to each other.

15 Claims, 6 Drawing Sheets

(52) U.S. Cl.
CPC ..... *G09G 2300/0426* (2013.01); *G09G 2300/0452* (2013.01); *G09G 2300/0456* (2013.01); *G09G 2300/0852* (2013.01); *G09G 2310/08* (2013.01)

(58) Field of Classification Search
CPC ... G09G 2300/0426; G09G 2300/0452; G09G 2300/0456; G09G 2300/0852
See application file for complete search history.

(56) References Cited

U.S. PATENT DOCUMENTS

| | | | | |
|---|---|---|---|---|
| 2011/0205200 | A1* | 8/2011 | Tsubata | G02F 1/136213 345/206 |
| 2012/0299947 | A1 | 11/2012 | Tsuda et al. | |
| 2013/0063499 | A1* | 3/2013 | Tanaka | G09G 3/3648 345/690 |
| 2015/0109267 | A1 | 4/2015 | Aoki et al. | |
| 2015/0187307 | A1* | 7/2015 | Jin | G09G 3/3648 257/72 |

FOREIGN PATENT DOCUMENTS

| | | | |
|---|---|---|---|
| WO | WO 2011/089838 | A1 | 7/2011 |
| WO | WO 2011/093374 | A1 | 8/2011 |

* cited by examiner

DISPLAY DEVICE AND REFLECTIVE LIQUID CRYSTAL DISPLAY DEVICE

CROSS-REFERENCE TO RELATED APPLICATIONS

This application is based upon and claims the benefit of priority from Japanese Patent Application No. 2014-040219, filed Mar. 3, 2014, the entire contents of which are incorporated herein by reference.

FIELD

Embodiments described herein relate generally to a display device and a reflective liquid crystal display device.

BACKGROUND

Liquid crystal display devices are commercially well-known. Furthermore, in recent years, mobile devices are used in increasingly wide purposes. As such mobile devices, smartphones with liquid crystal display devices are well known, for example. As to such liquid crystal display devices, improvement of display quality is in great demand to achieve higher definition, higher color purity, and higher brightness of the display. Furthermore, lower energy consumption is also in great demand to achieve a longer battery drive.

In order to satisfy the above contradictory demands for achieving the higher color purity, higher brightness, and lower power consumption at the same time, research and development of liquid crystal display devices using a pixel structure of four color pixels: red, green, blue, and white (RGBW) are keen to substitute an ordinary pixel structure of three color pixels: red, green, and blue (RGB).

However, when using a so-called RGBW stripe pixel structure (in which columns of four pixels of RGBW extending linearly are arranged in a row direction), each pixel has a slender shape which causes a significant decrease in display uniformity. To solve such a problem of the decrease in display quality, a so-called RGBW square pixel structure (in which four pixels of RGBW are arranged in a square) is under development.

Here, comparing the RGBW square pixel structure to the RGBW stripe pixel structure, the number of pixels arranged in each column of the RGBW square pixel structure is twice that of the RGBW stripe pixel structure. That is, the number of scanning lines of the RGBW square pixel structure is twice as much, too. What should be noted here is a writing time. The writing time of image signals from signal lines to pixels varies depending on the number of scanning lines, and the time must be shortened proportionately if the number of scanning lines increases. The resolution in the horizontal direction can be improved by simply increasing the number of signal lines and it has no effect on the writing time. However, when higher definition of display performance and greater frame frequency are aimed, reduction of the writing time of image signals is inevitable. As a result, a writing time of image signals will become insufficient and energy consumption in a driving circuit will increase significantly due to the increase of driving frequency.

In consideration of the above, there is a technique under development which provides one scanning line per row of RGBW square pixels while providing two signal lines per column of RGBW square pixels. That is, four pixels of an RGBW square pixel share a single scanning line. With this technique, even when the RGBW square pixel structure is used and the driving frequency is increased, a sufficient writing time of image signals can be secured. Furthermore, the energy consumption in a driving circuit can be suppressed, thereby to achieve lower power consumption.

However, when two signals lines are provided per one column on which pixels are aligned, the coupling capacitance produced between neighboring signal lines may increase to produce noise on the signal lines. The noise on a signal line undesirably varies the voltage value on the image signal applied to the signal line, creating an error in the voltage value. This causes the degradation of display quality.

BRIEF DESCRIPTION OF THE DRAWINGS

A general architecture that implements the various features of the embodiments will now be described with reference to the drawings. The drawings and the associated descriptions are provided to illustrate the embodiments and not to limit the scope of the invention.

DETAILED DESCRIPTION

Various embodiments will be described hereinafter with reference to the accompanying drawings.

In general, according to one embodiment, a display device includes, a unit pixel comprising a first pixel comprising a first pixel electrode, a second pixel neighboring to the first pixel in a column direction and comprising a second pixel electrode, a third pixel neighboring to the first pixel in a row direction and comprising a third pixel electrode, and a fourth pixel neighboring to the second pixel in the row direction and to the third pixel in the column direction and comprising a fourth pixel electrode;

a scanning line extending in the row direction and electrically connected to the first to fourth pixels;

first to fourth signal lines extending in the column direction and provided at intervals therebetween in the column direction, wherein the first signal line is located in an area opposing the first and second pixel electrodes in the column direction and is electrically connected to the first pixel, the second signal line is located in an area opposing the first and second pixel electrodes in the column direction and is electrically connected to the second pixel, the third signal line is located in an area opposing the third and fourth pixel electrodes in the column direction and is electrically connected to the third pixel, the fourth signal line is located in an area opposing the third and fourth pixel electrodes in the column direction and is electrically connected to the fourth pixel, and video signal potentials for inverted drive applied to the first and second signal lines are inverted in polarity with respect to each other, and video signal potentials for inverted drive applied to the third and fourth signal lines are inverted in polarity with respect to each other.

Hereinafter, embodiments of the present application will be explained with reference to accompanying drawings.

Note that the disclosure is presented for the sake of exemplification, and any modification and variation conceived within the scope and spirit of the invention by a person having ordinary skill in the art are naturally encompassed in the scope of invention of the present application. Furthermore, a width, thickness, shape, and the like of each element are depicted schematically in the Figures as compared to actual embodiments for the sake of simpler explanation, and they are not to limit the interpretation of the invention of the present application. Furthermore, in the description and Figures of the present application, structural elements having the same or similar functions will be referred to by the same reference numbers and detailed explanations of them that are considered redundant may be omitted.

First Embodiment

Figure 1:
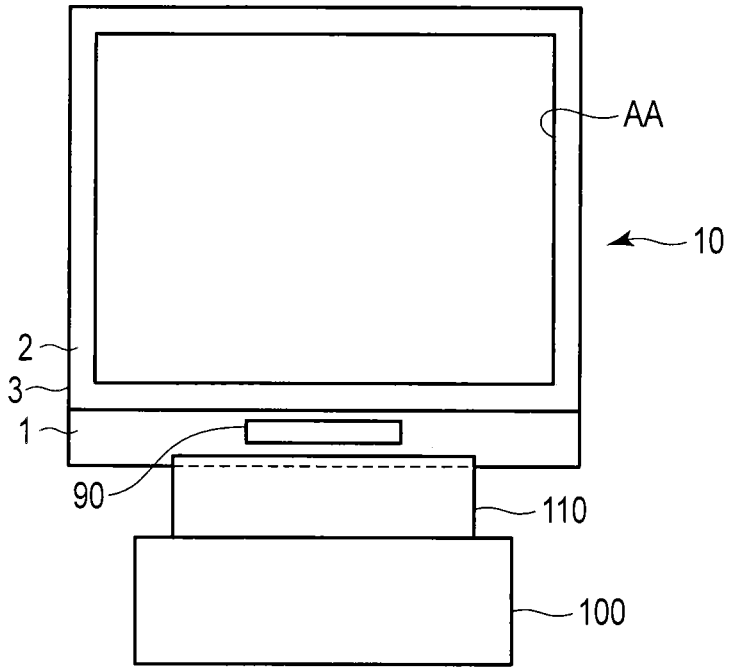
FIG. 1 is a plan view which schematically shows a reflective liquid crystal display device of an embodiment.

FIG. 1 is a plan view which schematically shows a reflective liquid crystal display device of first embodiment.

The liquid crystal display device includes a liquid crystal display panel 10, signal line driving circuit 90, control unit 100, and flexible printed circuit (FPC) 110.

The liquid crystal display panel 10 includes an array substrate 1, counter-substrate 2 opposing the array substrate 1 with a certain gap therebetween, and liquid crystal layer 3 which is held between these substrates. The signal line driving circuit 90 functions as an image signal output unit. The control unit 100 controls whole functions of the liquid crystal display device. FPC 110 is a communication path to send/receive signals used to drive the liquid crystal display panel 10. Furthermore, in a display area AA of the liquid crystal display panel 10, pixels PX described later are arranged in a matrix.

Figure 2:
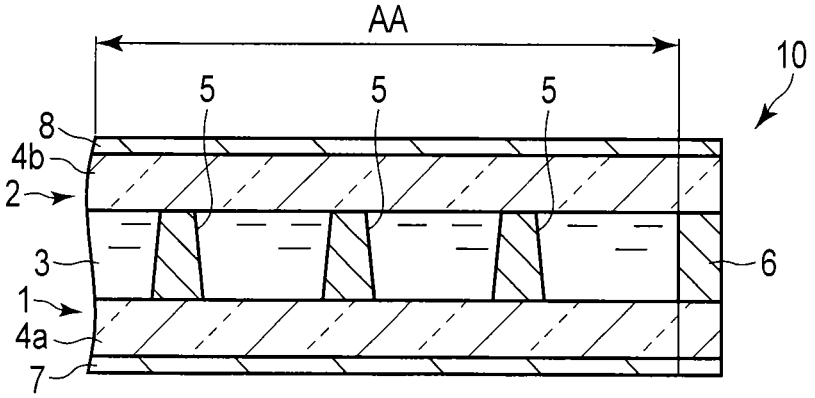
FIG. 2 is a cross-sectional view which schematically shows the reflective liquid crystal display device of this embodiment.

FIG. 2 is a cross-sectional view which schematically shows the reflective liquid crystal display device of the first embodiment.

As mentioned above, the liquid crystal display panel 10 includes the array substrate 1, counter-substrate 2, and liquid crystal layer 3 held between these substrates.

The array substrate 1 includes, for example, a glass substrate 4*a* as a transparent insulating substrate. On a surface of the glass substrate 4*a* which opposes the liquid crystal layer 3, a pixel electrode (reflecting electrode), and a pixel circuit composed of a scanning line, signal line, switching element (those are described later), and the like are layered. A first optical part 7 is provided on an external surface of the array substrate 1 (the opposite surface to the surface facing the liquid crystal layer 3). The first optical part 7 is, for example, a polarizer.

The counter-substrate 2 includes, for example, a glass substrate 4*b* as a transparent insulating substrate. Although this is not depicted, a color filter, counter-substrate (common electrode), and alignment film are formed successively upon the glass substrate 4*b* to form the counter-substrate 2. A second optical part 8 is provided on an external surface of the counter-substrate 2 (the opposite surface to the surface facing the liquid crystal layer 3). The second optical part 8 is, for example, a polarizer. The external surface of the second optical part 8 is a display surface.

The gap between the array substrate 1 and the counter-substrate 2 is held by, for example, columnar spacers 5. The array substrate 1 and the counter-substrate 2 are attached by a sealant 6 disposed at the peripheries of these substrates.

Figure 3:
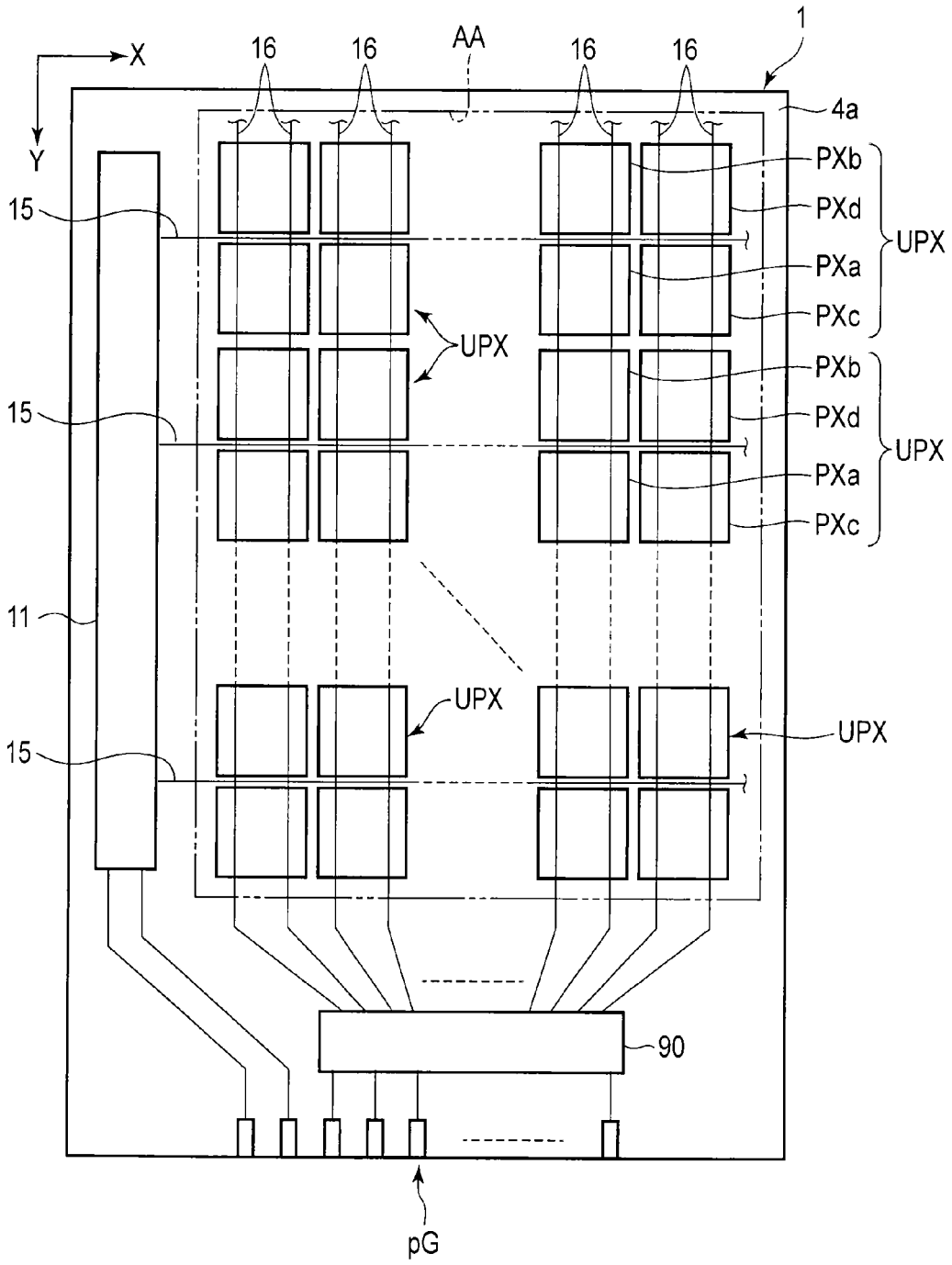
FIG. 3 is a plan view which schematically shows an array substrate of the reflective liquid crystal display device of the embodiment.

FIG. 3 is a plan view which schematically shows the array substrate of the reflective liquid crystal display device of the first embodiment.

In the display area AA, a plurality of unit pixels UPX arranged in a matrix are formed on the glass substrate 4*a*. The unit pixels UPX are arranged in a matrix of m×n where m is the number of unit pixels in row direction X and n is the number of unit pixels in column direction Y which is perpendicular to the row direction X. Here, the unit pixel UPX is an RGBW square pixel.

Each unit pixel UPX includes a plurality of pixels PX. In this embodiment, each unit pixel UPX includes first pixel PXa to fourth pixel PXd. Second pixel PXb is adjacent to first pixel PXa in the column direction Y. Third pixel PXc is adjacent to first pixel PXa in the row direction X. Fourth pixel PXd is adjacent to second pixel PXb in the row direction X and to third pixel PXc in the column direction Y.

Here, referring to a unit of pixels PX instead of the unit pixels UPX, the pixels PX are arranged in a matrix of 2m×2n where 2m is the number of pixels in the row direction X and 2n is the number of pixels in the column direction Y. In the odd-number rows, the second pixels PXb and the fourth pixels PXd are arranged alternately. In the even-number rows, the first pixels PXa and the third pixels PXc are arranged alternately. In the odd-number columns, the second pixel PXb and the first pixel PXa are arranged alternately. In the even-number columns, the fourth pixels PXd and the third pixels PXc are arranged alternately.

Note that the unit pixel UPX may be interpreted as a picture element. Furthermore, the unit pixel UPX may be interpreted as a pixel, and in that case, the pixel PX may be interpreted as a subpixel.

Outside the display area AA, a scanning line driving circuit 11 and a pad group pG of outer lead bonding are formed on the glass substrate 4*a*.

In the display area AA, a plurality (n) of scanning lines 15, and a plurality (4*m*) of signal lines 16 are disposed. The signal lines 16 extend in the column direction Y and are disposed at intervals in the row direction X. The scanning lines 15 extend in the row direction X and are electrically connected to the first pixel PXa to fourth pixel PXd. First pixels PXa to fourth pixels PXd of the unit pixels UPX aligned in the row direction X are electrically connected to a single scanning line 15.

Figure 4:
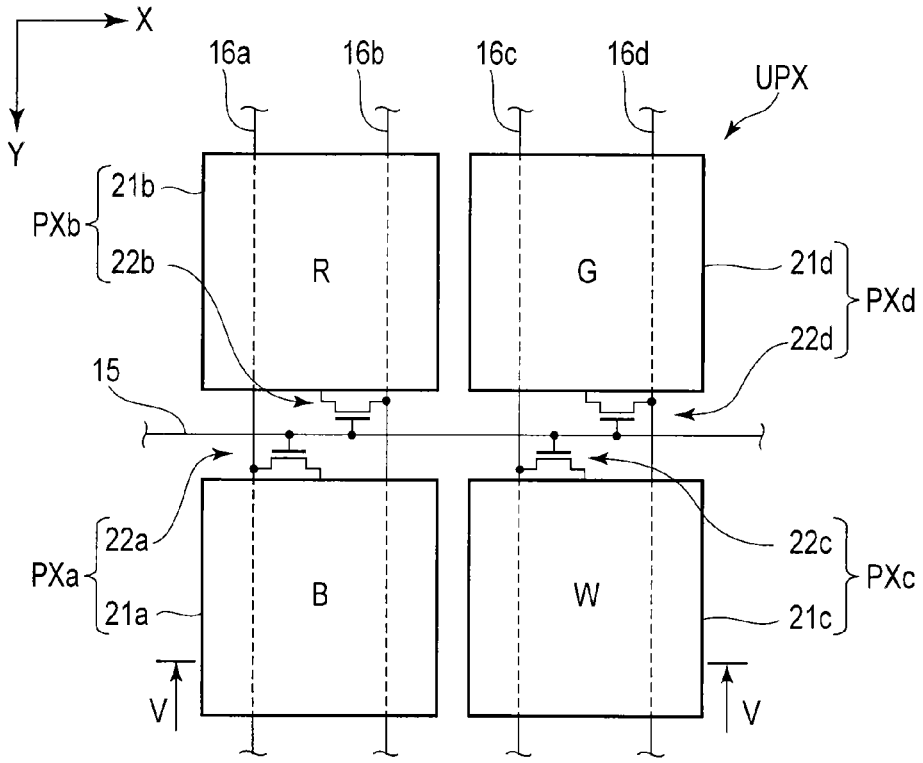
FIG. 4 is a view which specifically illustrates one of unit pixels on the array substrate of the reflective liquid crystal display device of this embodiment.

FIG. 4 is a plan view which specifically illustrates one of the unit pixels UPX of the reflection-type liquid crystal display device of the first embodiment.

As shown in FIGS. 3 and 4, of these signal lines 16, four lines, namely, first signal line 16*a* to fourth signal line 16*d* correspond to unit pixels UPX aligned in the column direction Y. First pixel PXa to fourth pixel PXd are configured to display different colors. In the present embodiment, first pixel PXa to fourth pixel PXd display the colors of red (R), green (G), blue (B) and white (achromatic color, W), respectively.

First pixel PXa includes first pixel electrode 21*a* and first switching element 22*a*, and is configured to display a color of blue (B). First switching element 22*a* is electrically connected to a scanning line 15, first signal line 16*a* and first pixel electrode 21*a*. In this embodiment, first switching element 22*a* is formed of a thin-film transistor (TFT). First switching element 22*a* includes a gate electrode electrically connected to the scanning line 15, a source electrode electrically connected to first signal line 16*a* and a drain electrode electrically connected to first pixel electrode 21*a*.

Second pixel PXb includes second pixel electrode 21*b* and second switching element 22*b*, and is configured to display the color red (R). Second switching element 22*b* is electrically connected to a scanning line 15, second signal line 16*b* and second pixel electrode 21*b*. In this embodiment, second switching element 22*b* is formed of a TFT. Second switching element 22*b* includes a gate electrode electrically connected to the scanning line 15, a source electrode electrically connected to second signal line 16*b* and a drain electrode electrically connected to second pixel electrode 21*b*.

Third pixel PXc includes third pixel electrode 21*c* and third switching element 22*c*, and is configured to display the color white (R). Third switching element 22*c* is electrically connected to a scanning line 15, third signal line 16*c* and third pixel electrode 21*c*. In this embodiment, third switching element 22*c* is formed of a TFT. Third switching element 22*c* includes a gate electrode electrically connected to the scanning line 15, a source electrode electrically connected to third signal line 16*c* and a drain electrode electrically connected to third pixel electrode 21*c*.

Fourth pixel PXd includes fourth pixel electrode 21*d* and fourth switching element 22*d*, and is configured to display a color of green (G). Fourth switching element 22*d* is electrically connected to a scanning line 15, fourth signal line 16*d* and fourth pixel electrode 21*d*. In this embodiment, fourth switching element 22*d* is formed of a TFT. Fourth switching element 22*d* includes a gate electrode electrically connected to the scanning line 15, a source electrode electrically connected to fourth signal line 16*d* and a drain electrode electrically connected to fourth pixel electrode 21*d*.

Figure 5:
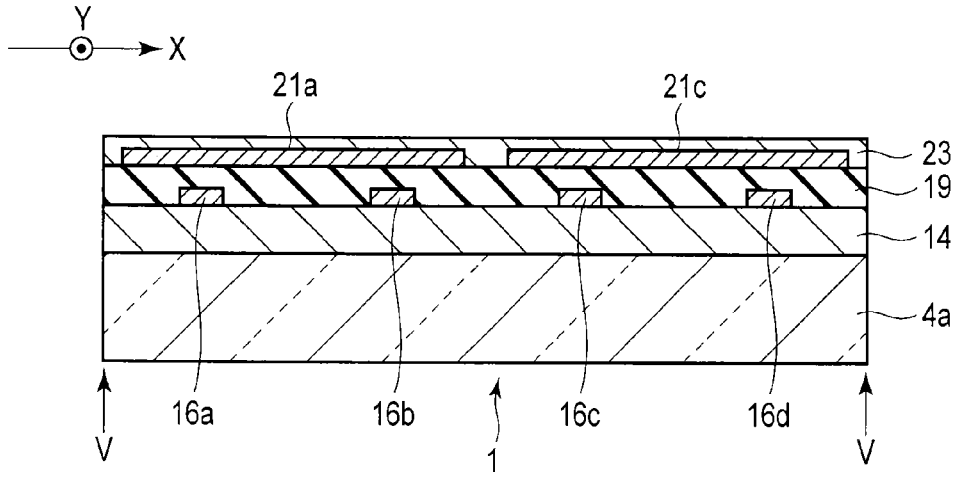
FIG. 5 is a cross-sectional view which schematically shows a layered structure of the array substrate of the reflective liquid crystal display device of this embodiment.

FIG. 5 is a cross-sectional view which schematically shows a layered structure of the array substrate 1 of the reflective liquid crystal display device of this embodiment. FIG. 5 is a cross-section of first pixel PXa and third pixel PXc taken along arrow V-V of FIG. 4.

An underlying part 14 is formed on glass substrate 4*a*. Although this is not shown, the underlying part 14 is formed of an undercoat film, first switching element 22*a*, third switching element 22*c* (semiconductor layer, gate insulating film, gate electrode, etc.), a scanning line, interlayer insulating film and the like, layered in the order. The gate electrodes of first switching element 22*a* and third switching element 22*c* can be formed by extending a part of the scanning line 15.

Signal lines 16 and the like are formed on the underlying part 14. A flattening film 19 is formed on the underlying part 14 and the signal lines 16. The flattening film 19 has a function of reducing irregularities on the surface of the array substrate 1. First pixel electrode 21*a* and third pixel electrode 21*c* are formed on the flattening film 19. An alignment film 23 is formed on the flattening film 19 and the pixel electrode 21, and thus the array substrate 1 is formed.

The liquid crystal display device formed as described above is of a light-reflective type. Accordingly, first pixel PXa to fourth pixel PXd shown in FIGS. 3 to 5 are light-reflective pixels. In this embodiment, first pixel electrode 21*a* to fourth pixel electrode 21*d* are light-reflective electrodes and include a conductive layer made of a material having light reflectivity, such as aluminum (Al). With this structure, the first pixel electrode 21*a* to fourth pixel electrode 21*d* reflect light entering from the display surface side (the outer surface of the second optical unit 8) to the display surface side.

First signal lines 16*a* to fourth signal lines 16*d* will now be described in detail.

First signal lines 16*a* to fourth signal lines 16*d* are provided closer to glass substrate 4*a* than first pixel electrode 21*a* to fourth pixel electrode 21*d*. In other words, first pixel electrode 21*a* to fourth pixel electrode 21*d* are provided closer to a display surface side than first signal lines 16*a* to fourth signal lines 16*d*.

First signal line 16*a* is located in an area opposing first pixel electrode 21*a* and second pixel electrode 21*b* in the row direction X, and is electrically connected to first pixel PXa (first switching element 22*a*). Second signal line 16*b* is located in an area opposing first pixel electrode 21*a* and second pixel electrode 21*b* in the row direction X, and is electrically connected to second pixel PXb (second switching element 22*b*). Third signal line 16*c* is located in an area opposing third pixel electrode 21*c* and fourth pixel electrode 21*d* in the row direction X, and is electrically connected to third pixel PXc (third switching element 22*c*). Fourth signal line 16*d* is located in an area opposing third pixel electrode 21*c* and fourth pixel electrode 21*d* in the row direction X, and is electrically connected to fourth pixel PXd (fourth switching element 22*d*).

In this embodiment, the signal lines 16 (first signal line 16*a* to fourth signal line 16*d*) are disposed at equal intervals in the row direction X. In the row direction X, the signal lines 16 are located apart by a gap from a side edge of the pixel electrodes 21 opposing thereto. The scanning lines 15 are electrically connected to first pixel PXa to fourth pixel PXd of each of unit pixels UPX aligned in the row direction X.

According to this embodiment with the above-described structure, the liquid crystal display device includes a plurality of unit pixels UPX, a plurality of scanning lines 15 and a plurality of signal lines 16. Each unit pixel UPX includes first pixel Pxa to fourth pixel PXd, which are formed in square matrix. The shape of each of first pixel Pxa to fourth pixel PXd is substantially square. The liquid crystal display device employs the so-called RGBW square pixel structure, and therefore it can suppress the degradation of evenness of display as compared to the case of the so-called RGBW stripe pixel structure.

One signal line 15 is shared by a plurality of pixels PX (PXa, PXb, PXc and PXd) aligned in two columns, and two signal lines 16 are provided per one row of pixels PX (that is, PXa and PXb or PXc and PXd). With this arrangement, even if the liquid crystal display device employs the RGBW square pixel structure and the driving frequency for signal lines 16 (frequency of video signals applied to signal lines 16) is increased, it is possible to sufficiently secure the time for writing video signals. Further, the number of scanning lines 15 can be reduced to a half, and accordingly the number of control signals produced by the scanning line driving circuit 11, the control unit 10 and the like for driving the scanning lines 15 can be reduced to a half. Consequently, the increase in power consumption by the driving circuit (scanning line driving circuit 11) can be suppressed, (thus achieving lower power consumption).

Further, in this embodiment, two signal lines 16 are provided per one row in which a plurality of pixels PX are aligned, and therefore the driving frequency for the signal lines 16 can be decreased to a half as compared to the case where signal lines 16 are connected to all of pixels PX aligned in one row. Thus, the increase in power consumption of the external source IC (signal line driving circuit 90 and control unit 100) can be suppressed.

First signal line 16*a* and second signal line 16*b* are located in an area opposing first pixel electrode 21*a* and second pixel electrode 21*b*. Third signal line 16*c* and fourth signal line 16*d* are located in an area opposing third pixel electrode 21*c* and fourth pixel electrode 21*d*. First pixel electrode 21*a* and second pixel electrode 21*b* function as shield electrodes for first signal line 16*a* and second signal line 16*b*, and thus electrostatically shield first signal line 16*a* and second signal line 16*b*. Third pixel electrode 21*c* and fourth pixel electrode 21*d* function as shield electrodes for third signal line 16*c* and fourth signal line 16*d*, and thus electrostatically shield third signal line 16*c* and fourth signal line 16*d*.

Further, in the row direction X, signal lines 16 need not be provided in a narrow gap between neighboring pairs of pixel electrodes 21 (pixels PX). With this structure, if two signal lines 16 are provided per one row on which pixels PX are aligned, coupling capacitance, which may be produced between neighboring signal lines 16, can be suppressed, and therefore noise which may be produced on the signal lines 16 can be reduced. Consequently, undesired variation in voltage value of image signals applied to the signal lines 16 can be reduced, thus suppressing the degradation of display quality.

Note that the signal lines 16 of this embodiment are provided at equal intervals in the row direction X. The interval between each neighboring pair of signal lines 16 can be increased to make it difficult to produce coupling capacitance between signal lines 16. Thus, the degradation of display quality can be further suppressed. Further, even if coupling capacitance is produced between a neighboring pair of signal lines 16, the coupling capacitance produced in the signal lines 16 can be balanced, thereby making it possible to suppress the degradation of display quality in this way as well.

Moreover, the pixel electrodes 21 are light-reflective electrodes, and provided closer to the display surface side than the signal line 16. With this structure, the signal lines 16 generally made of a metal and having light-shielding properties do not reduce the aperture. Therefore, the light-reflective liquid crystal display device of this embodiment can achieve an increase in aperture (light-reflectivity) as compared to the light-transmissive liquid crystal display device.

In the row direction X, the signal lines 16 are located on side edges of the pixel electrodes 21 opposing thereto with a gap therebetween. In consideration of the accuracy of the manufacturing device including an exposure device or the like, the signal lines 16 are provided to be located with margins from the side edges of the pixel electrodes 21. Therefore, the signal lines 16 can be provided without extending off the regions opposing the respective pixel electrodes 21 in the row direction X.

With the above-described structure, a liquid crystal display device which can achieve low power consumption and has an excellent display quality can be obtained.

Next, a method of further proving the display quality will now be described.

Figure 6:
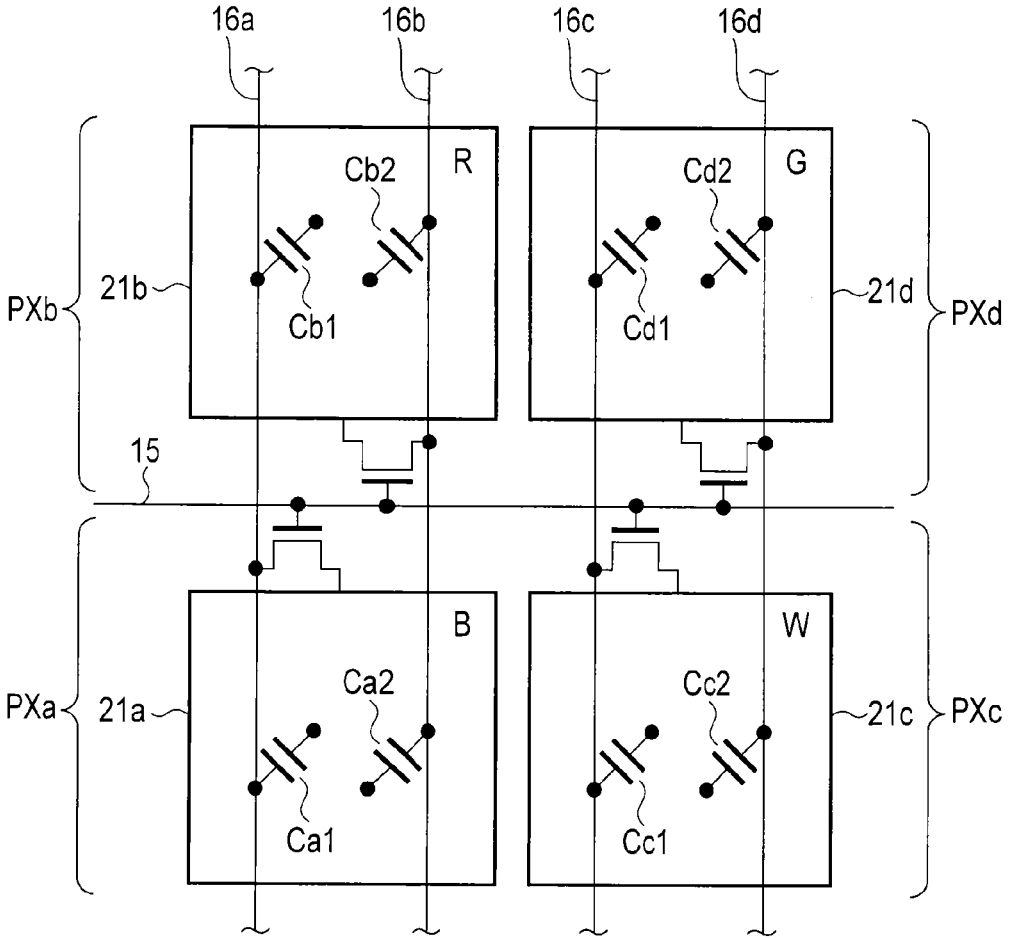
FIG. 6 is a diagram which shows coupling capacitances between pixel electrodes and signal lines of the reflective liquid crystal display device of this embodiment.

FIG. 6 is a diagram which shows coupling capacitances between pixel electrodes 21 and signal lines 16 of the reflective liquid crystal display device of this embodiment.

As to first pixel PXa, for example, coupling capacitance Ca1 exists between electrode 21*a* and signal line 16*a*, and coupling capacitance Ca2 exists between electrode 21*a* and signal line 16*b*. As to second pixel PXb to fourth pixel PXd, coupling capacitances Cb1 to Cd2 exist in similar manners. Here, with the arrangement of signal lines 16 in areas opposing the pixel electrodes 21 as described above, pixel electrodes 21 and signal lines 16 are disposed close to each other, thereby increasing the coupling capacitance between each pixel electrode 21 and each respective signal line 16 as compared to the conventional technique.

Figure 7:
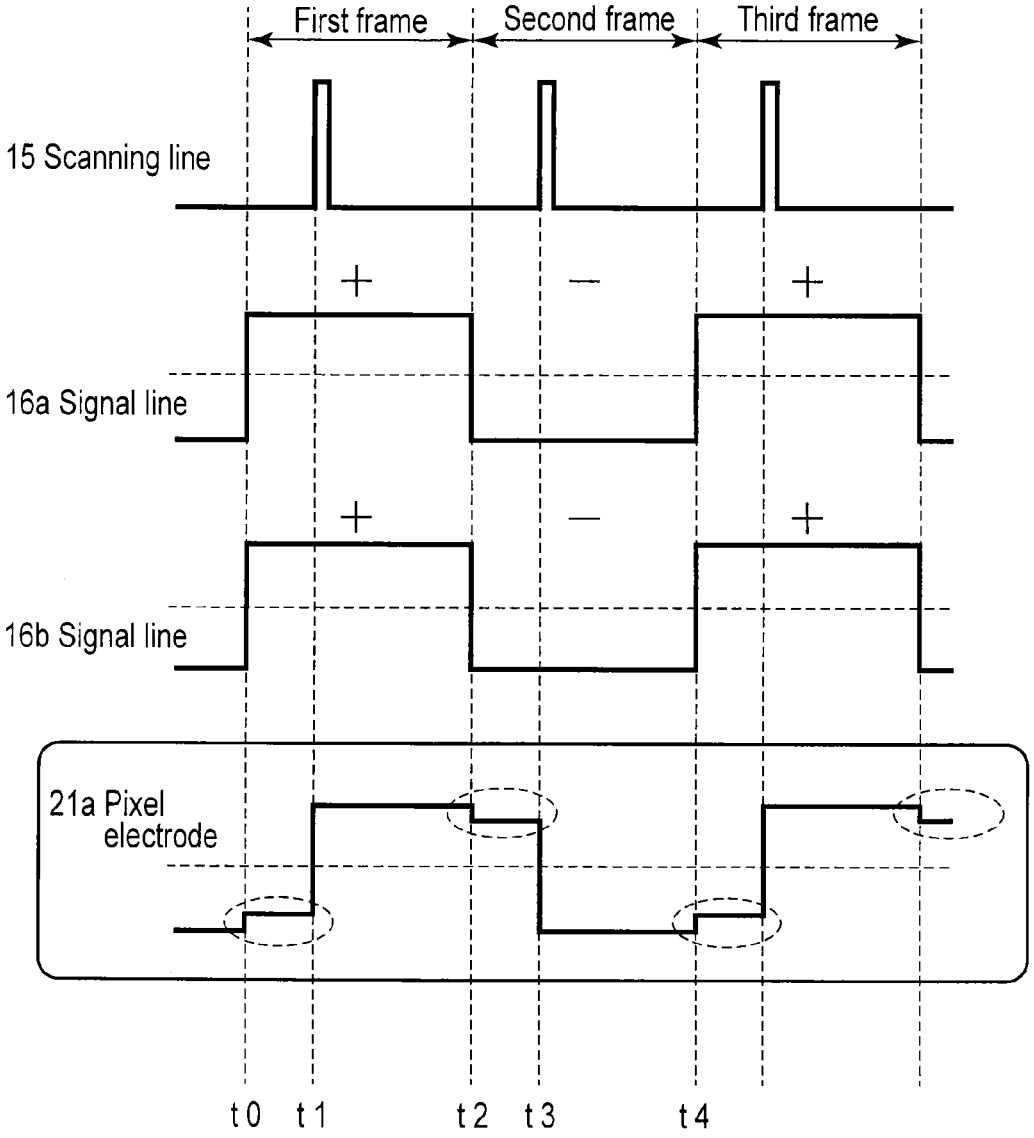
FIG. 7 is a diagram which illustrates an influence on display quality due to the existence of the coupling capacitances in the reflective liquid crystal display device of this embodiment.

FIG. 7 is a diagram which illustrates an influence on display quality due to the existence of the coupling capacitances in the reflective liquid crystal display device of this embodiment.

FIG. 7 shows potential changes in a scanning line 15, signal lines 16*a* and 16*b* and pixel electrode 21*a* in first pixel Pxa as an example. Potentials of video signals applied to signal lines 16*a* and 16*b* are inverted from one frame to another by an inversion drive such as dot inversion or line inversion.

At start time t0 of the first frame, potentials of positive polarity are applied as video signals to signal lines 16*a* and 16*b*, respectively. Here, a potential of negative polarity in one previous frame is still maintained at this point in pixel electrode 21*a*. Therefore, the potentials in signal lines 16*a* and 16*b* influence pixel electrode 21*a* via coupling capacitances Ca1 and Ca2 to vary the potential in pixel electrode 21*a* being in a holding state.

Then, at time t1, when a driving pulse signal is applied to the scanning line 15, the source electrode and drain electrode of first switching element 22*a* are brought into conduction, and thus a potential of positive polarity is applied to pixel electrode 21*a* from signal line 16*a*. Pixel electrode 21*a* holds the applied potential until start time t2 of the next frame, the second frame.

At start time t2 of the second frame, potentials of negative polarity are applied as video signals to signal lines 16*a* and 16*b*, respectively. Here, a potential of positive polarity in the previous frame, that is, the first frame, is still maintained at this point in pixel electrode 21*a*. Therefore, the potentials in signal lines 16*a* and 16*b* influence pixel electrode 21*a* via coupling capacitances Ca1 and Ca2 to vary the potential in pixel electrode 21*a* being in a holding state.

Then, at time t3, when a driving pulse signal is applied to the scanning line 15, the source electrode and drain electrode of first switching element 22*a* are brought into conduction, and thus a potential of negative polarity is applied to pixel electrode 21*a* from signal line 16*a*. Pixel electrode 21*a* holds the applied potential until start time t4 of the next frame, the third frame.

As described above, with the arrangement that two signal lines are disposed in an area opposing a pixel electrode 21, the coupling capacitance between the pixel electrode 21 and the signal lines 16 increases as compared to the conventional technique, and consequently, the pixel potential being in a holding state varies along with polarity inversion.

Figure 8:
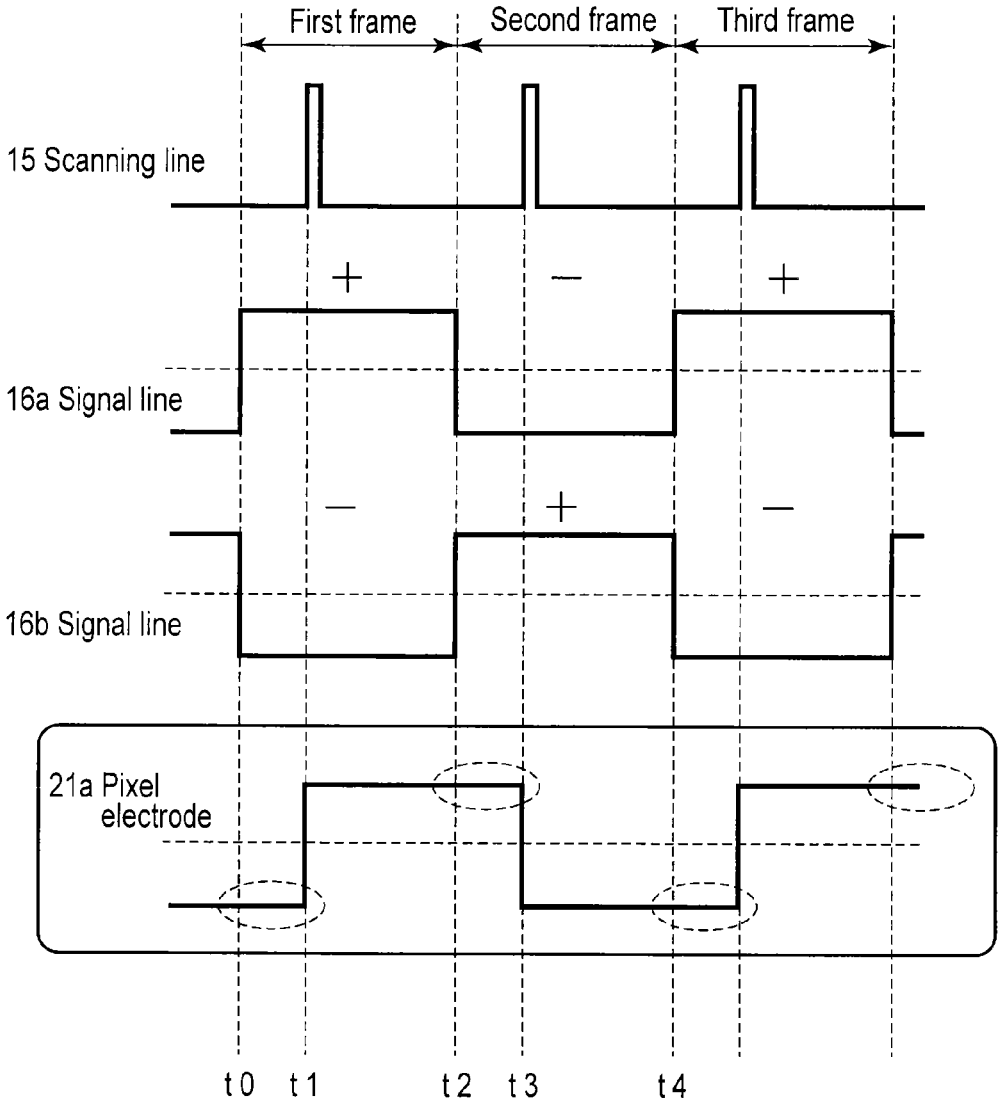
FIG. 8 is a diagram which illustrates a method of decreasing the influence on display quality due to the existence of the coupling capacitances in the reflective liquid crystal display device of this embodiment.

FIG. 8 is a diagram which illustrates a method of decreasing the influence on display quality due to the existence of the coupling capacitances in the reflective liquid crystal display device of this embodiment.

At start time t0 of the first frame, a potential of positive polarity is applied as a video signal to signal line 16*a*, whereas a potential of negative polarity to signal line 16*b* as a video signal. Here, a potential of negative polarity in one previous frame is still maintained at this point in pixel electrode 21*a*. Therefore, the potentials in signal lines 16*a* and 16*b* influence pixel electrode 21*a* via coupling capacitances Ca1 and Ca2. However, since the potentials in signal lines 16*a* and 16*b* are inverted to each other in polarity, the potential variation in pixel electrode 21*a* being in a holding state is significantly reduced.

Then, at time t1, when a driving pulse signal is applied to the scanning line 15, the source electrode and drain electrode of first switching element 22*a* are brought into conduction, and thus a potential of positive polarity is applied to pixel electrode 21*a* from signal line 16*a*. Pixel electrode 21*a* holds the applied potential until start time t2 of the next frame, the second frame.

At start time t2 of the second frame, a potential of negative polarity is applied as a video signal to signal line 16*a*, whereas a potential of positive polarity to signal line 16*b* as a video signal. Here, a potential of positive polarity in the previous frame, that is, the first frame, is still maintained at this point in pixel electrode 21*a*. Therefore, the potentials in signal lines 16*a* and 16*b* influence pixel electrode 21*a* via coupling capacitances Ca1 and Ca2. However, since the potentials in signal lines 16*a* and 16*b* are inverted to each other in polarity, the potential variation in pixel electrode 21*a* being in a holding state is significantly reduced.

Then, at time t3, when a driving pulse signal is applied to the scanning line 15, the source electrode and drain electrode of first switching element 22*a* are brought into conduction, and thus a potential of negative polarity is applied to pixel electrode 21*a* from signal line 16*a*. Pixel electrode 21*a* holds the applied potential until start time t4 of the next frame, the third frame.

As described above, with the arrangement that potentials applied to two signal lines disposed in an area opposing a pixel electrode 21 are inverted in polarity, the potential variation in pixel electrode 21*a* being in a holding state, which is caused by the increase in coupling capacitance between the pixel electrodes 21 and the signal lines 16, can be significantly reduced.

Note that FIGS. 7 and 8 illustrate the case of first pixel PXa as an example, but similar explanations can be made for second pixel PXb to fourth pixel PXd as well.

Further, in the above-described inverted drive, inverted polarities applied to two signal lines 16 in an area opposing a pixel electrode 21 can be set independently for each of pixel electrodes of neighboring pairs aligned in the row direction.

The colors used in the square pixel or arrangement of colors in the square pixel are not limited to the examples of the above-described embodiments.

Also, in the above-provided embodiments, the terms, square pixel and unit pixel are used for the sake of explanation, but naturally, the embodiments are not limited to square pixels.

All display devices which can be put to practical use by a person with ordinary skill in the art by changing as appropriate the designs of the display devices according to the above embodiments are covered by the disclosure of the present application with respect to the present invention, as long as they are made to have the subject matter of the present invention.

It can be understood that various modifications of the embodiments of the present invention can be conceived by a person with ordinary skill in the art, and also fall within the scope of disclosure of the present application with respect to the present invention. For example, with respect to the above embodiments, if a person with ordinary skill in the art adds or deletes a structural element or changes a design as appropriate, or adds or omits a step or changes a design, a modification obtained by such a change also falls within the scope of disclosure of the present application with respect to the present invention, as long as it has the subject matter of the present invention.

In addition, in addition to the above advantages obtained by the above embodiments, if another or other advantages can be obviously considered to be obtained by the embodiment or embodiments from the specification or can be conceived as appropriate by a person with ordinary sill in the art from the specification, it is understood that such another or other advantages can also be obtained by the present invention.

It is also possible to make various inventions by combining as appropriate the structural elements as disclosed with respect to the above embodiments. For example, some of the structural elements in the embodiments may be deleted. Also, structural elements used in both the embodiments may be combined as appropriate.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A display device comprising:

a unit pixel comprising a first pixel comprising a first pixel electrode, a second pixel neighboring to the first pixel in a column direction and comprising a second pixel electrode, a third pixel neighboring to the first pixel in a row direction and comprising a third pixel electrode, and a fourth pixel neighboring to the second pixel in the row direction and to the third pixel in the column direction and comprising a fourth pixel electrode;

a scanning line extending in the row direction and electrically connected to the first to fourth pixels;

first to fourth signal lines extending in the column direction and provided at intervals therebetween in the row direction, wherein the first signal line is electrically connected to the first pixel, and is located apart by a gap from side edges of the first and second pixel electrodes in the row direction, and an entire width in the row direction is included in an area opposing the first and second pixel electrodes in plan view, the second signal line is electrically connected to the second pixel, and is located apart by a gap from side edges of the first and second pixel electrodes in the row direction, and an entire width in the row direction is included in an area opposing the first and second pixel electrodes in plan view, the third signal line is electrically connected to the third pixel, and is located apart by a gap from side edges of the third and fourth pixel electrodes in the row direction, and an entire width in the row direction is included in an area opposing the third and fourth pixel electrodes in plan view, the fourth signal line is electrically connected to the fourth pixel, and is located apart by a gap from side edges of the third and fourth pixel electrodes in the row direction, and an entire width in the row direction is included in an area opposing the third and fourth pixel electrodes in plan view, and video signal potentials for inverted drive applied to the first and second signal lines are inverted in polarity with respect to each other, and video signal potentials for inverted drive applied to the third and fourth signal lines are inverted in polarity with respect to each other.

2. The display device according to claim 1, wherein the first to fourth pixels are light-reflective pixels.

3. The display device according to claim 2, wherein the first to fourth pixel electrodes are light-reflective pixel electrodes and are provided closer to a display surface side than the first to fourth signal lines.

4. The display device according to claim 1, wherein the first to fourth pixels are configured to display colors different from each other.

5. The display device according to claim 4, wherein the first to fourth pixels comprise one configured to display a color red, one configured to display a color green, one configured to display a color blue, and one configured to display a color white.

6. The display device according to claim 1, wherein the first to fourth signal lines are provided at equal intervals in the row direction.

7. The display device according to claim 1, wherein the first pixel comprises a first switching element electrically connected to the scanning line, the first signal line and the first pixel electrode, the second pixel comprises a second switching element electrically connected to the scanning line, the second signal line and the second pixel electrode, the third pixel comprises a third switching element electrically connected to the scanning line, the third signal line and the third pixel electrode, and the fourth pixel comprises a fourth switching element electrically connected to the scanning line, the fourth signal line and the fourth pixel electrode.

8. A liquid crystal display device comprising:

a unit pixel comprising a first pixel comprising a first pixel electrode, a second pixel neighboring to the first pixel in a column direction and comprising a second pixel electrode, a third pixel neighboring to the first pixel in a row direction and comprising a third pixel electrode, and a fourth pixel neighboring to the second pixel in the row direction and to the third pixel in the column direction and comprising a fourth pixel electrode;

a scanning line extending in the row direction and electrically connected to the first to fourth pixels;

first to fourth signal lines extending in the column direction and provided at intervals therebetween in the row direction, wherein the first signal line is electrically connected to the first pixel, and is located apart by a gap from side edges of the first and second pixel electrodes in the row direction, and an entire width in the row direction is included in an area opposing the first and second pixel electrodes in plan view, the second signal line is electrically connected to the second pixel, and is located apart by a gap from side edges of the first and second pixel electrodes in the row direction, and an entire width in the row direction is included in an area opposing the first and second pixel electrodes in plan view, the third signal line is electrically connected to the third pixel, and is located apart by a gap from side edges of the third and fourth pixel electrodes in the row direction, and an entire width in the row direction is included in an area opposing the third and fourth pixel electrodes in plan view, the fourth signal line is electrically connected to the fourth pixel, and is located apart by a gap from side edges of the third and fourth pixel electrodes in the row direction, and an entire width in the row direction is included in an area opposing the third and fourth pixel electrodes in plan view, and video signal potentials for inverted drive applied to the first and second signal lines are inverted in polarity with respect to each other, and video signal potentials for inverted drive applied to the third and fourth signal lines are inverted in polarity with respect to each other.

9. A reflective liquid crystal display device comprising:

a pixel area comprising unit pixels arranged in matrix, each comprising a first pixel comprising a first pixel electrode, a second pixel neighboring to the first pixel in a column direction and comprising a second pixel electrode, a third pixel neighboring to the first pixel in a row direction and comprising a third pixel electrode, and a fourth pixel neighboring to the second pixel in the row direction and to the third pixel in the column direction and comprising a fourth pixel electrode;

an array substrate including the pixel area;

a counter-substrate provided to oppose the array substrate;

a scanning line extending in the row direction and electrically connected to the first to fourth pixels of each of the unit pixels;

first to fourth signal lines extending in the column direction and provided at intervals therebetween in the row direction in each of unit pixels, wherein the first signal line is electrically connected to the first pixel, and is located apart by a gap from side edges of the first and second pixel electrodes in the row direction, and an entire width in the row direction is included in an area opposing the first and second pixel electrodes in plan view, the second signal line is electrically connected to the second pixel, and is located apart by a gap from side edges of the first and second pixel electrodes in the row direction, and an entire width in the row direction is included in an area opposing the first and second pixel electrodes in plan view, the third signal line is electrically connected to the third pixel, and is located apart by a gap from side edges of the third and fourth pixel electrodes in the row direction, and an entire width in the row direction is included in an area opposing the third and fourth pixel electrodes in plan view, the fourth signal line is electrically connected to the fourth pixel, and is located apart by a gap from side edges of the third and fourth pixel electrodes in the row direction, and an entire width in the row direction is included in an area opposing the third and fourth pixel electrodes in plan view, and video signal potentials for inverted drive applied to the first and second signal lines are inverted in polarity with respect to each other, and video signal potentials for inverted drive applied to the third and fourth signal lines are inverted in polarity with respect to each other.

10. The display device according to claim 9, wherein the first to fourth pixels are light-reflective pixels.

11. The display device according to claim 10, wherein the first to fourth pixel electrodes are light-reflective pixel electrodes and are provided closer to a display surface side than the first to fourth signal lines.

12. The display device according to claim 9, wherein the first to fourth pixels are configured to display colors different from each other.

13. The display device according to claim 12, wherein the first to fourth pixels comprise one configured to display a color red, one configured to display a color green, one configured to display a color blue, and one configured to display a color white.

14. The display device according to claim 9, wherein the first to fourth signal lines are provided at equal intervals in the row direction.

15. The display device according to claim 9, wherein the first pixel comprises a first switching element electrically connected to the scanning line, the first signal line and the first pixel electrode, the second pixel comprises a second switching element electrically connected to the scanning line, the second signal line and the second pixel electrode, the third pixel comprises a third switching element electrically connected to the scanning line, the third signal line and the third pixel electrode, and the fourth pixel comprises a fourth switching element electrically connected to the scanning line, the fourth signal line and the fourth pixel electrode.

* * * * *